United States Patent [19]

Takenaka et al.

[11] Patent Number: 4,684,449

[45] Date of Patent: Aug. 4, 1987

[54] PROCESS FOR PRODUCING M-HYDROXYBENZYL ALCOHOL

[75] Inventors: Shinji Takenaka; Ryu Oi; Chitoshi Shimakawa, all of Ohmuta, Japan

[73] Assignee: Mitsui Toatsu Chemicals, Inc., Tokyo, Japan

[21] Appl. No.: 932,333

[22] Filed: Nov. 19, 1986

[30] Foreign Application Priority Data

Nov. 26, 1985 [JP] Japan ..... 60-263858
Dec. 5, 1985 [JP] Japan ..... 60-272467

[51] Int. Cl.[4] ..... C07B 29/06; C07C 29/00

[52] U.S. Cl. ..... 204/75; 204/59 R; 204/72; 204/73 R; 204/76; 204/77

[58] Field of Search ..... 204/59 R, 72, 73 R, 204/75, 76, 77

[56] References Cited

U.S. PATENT DOCUMENTS 3,755,101 8/1973 Rakoutz ..... 204/75
4,381,229 4/1983 Donohue ..... 204/73 R
4,560,450 12/1985 Morduchowitz et al. ..... 204/76

FOREIGN PATENT DOCUMENTS 49-124011 11/1974 Japan ..... 204/73 R

OTHER PUBLICATIONS

Takenaka et al., Chem. Abstracts 104 (1986), #98055.
Bericht, 38, 1752 (1905).

*Primary Examiner*—Arthur P. Demers
*Attorney, Agent, or Firm*—Fisher, Christen & Sabol

[57] ABSTRACT

A process for producing m-hydroxybenzyl alcohol which comprises electrolytically reducing m-hydroxybenzoic acid in an acidic aqueous solution at a temperature of 20° to 70° while m-hydroxybenzyl alcohol is present always in the electrolytic solution. The constant presence of m-hydroxybenzyl alcohol is effected by (1) continuously adding m-hydroxybenzoic acid to the electrolytic solution in an amount corresponding to that consumed as the electrolytic reaction proceeds, or (2) by continuously adding m-hydroxybenzoic acid and the acidic aqueous solution to the electrolytic solution.

5 Claims, 2 Drawing Figures

PROCESS FOR PRODUCING M-HYDROXYBENZYL ALCOHOL

BACKGROUND OF THE INVENTION

This invention relates to a process for producing m-hydroxybenzyl alcohol (to be abbreviated mHBOH hereinafter).

mHBOH is a compound useful as an intermediate for industrial and agricultural chemicals, but to date, has not been commercially supplied by an inexpensive production method.

mHBOH has been synthesized, for example, by a fermentation method using m-cresol as a starting material, or methods relying on reduction and hydrogenation with sodium amalgam, $NaBH_4$, $LiAlH_4$, etc. using m-hydroxybenzaldehyde as a starting material. These methods, however, are not commercially feasible because of insufficient yields. Furthermore, since the hydrogenation reaction involves high temperatures and pressures, it raises various problems in industrial practice.

Reduction with sodium amalgam or electrolysis was proposed in the case of using m-hydroxybenzoic acid (to be abbreviated mHBA hereinafter) [Bericht, 38, 1752 (1905)]. This method, however, gives only a low yield, and cannot be an industrial method.

SUMMARY OF THE INVENTION

It is an object of this invention to provide a process which can produce m-hydroxybenzyl alcohol industrially from m-hydroxybenzoic acid.

Another object of this invention is to provide a process which can produce m-hydroxybenzyl alcohol industrially advantageously from m-hydroxybenzoic acid by an electroorganic chemical technique.

To obtain mHBOH in a high yield by the electrolytic reduction of mHBA, it is necessary that mHBA should dissolve uniformly in the electrolytic solution, the electrolytic reaction should proceed smoothly, and that no trouble should occur on the electrode surface.

mHBA has a low solubility in water, and it is very difficult to maintain its concentration in water at a high level. From the standpoint of production efficiency and economy in industrial practice, the concentration of mHBA is desirably at least 10%. To dissolve mHBA in water in a concentration of at least 10%, it is necessary to increase the solubility of mHBA by various means, for example by heating the mixture to at least 90° C., or using a quaternary ammonium salt as a supporting electrolytic substance and increasing the concentration of mHBA by its compatibility with the ammonium salt, or using a water-soluble organic solvent, or esterifying mHBA to increase its water solution.

To electrolyze mHBA in solution, it is necessary to maintain the solution acidic.

When the supporting electrolytic substance or organic solvent is used during the reaction, a procedure of separating mHBOH after the electrolysis from the organic solvent or the supporting electrolytic substance becomes complex, and this adds to the cost of production. In the method of increasing the solubility of mHBOH by raising the temperature, the rate of decompositon of mHBA in an acidic aqueous solution undesirably increases fast as the temperature rises.

The present inventors have made extensive investigations in order to solve these problems and achieve the aforesaid objects, and finally arrived at the present invention.

According to this invention, there is provided a process for producing m-hydroxybenzyl alcohol which comprises electrolytically reducing m-hydroxybenzoic acid in an acidic aqueous solution, wherein (1) m-hydroxybenzyl alcohol is caused to be present always in the electrolytic solution by continuously adding m-hydroxybenzoic acid to the electrolytic solution in an amount corresponding to that consumed as the electrolytic reaction proceeds, and the electrolysis is carried out at a temperature of 20° to 70° C.; or (2) m-hydroxybenzyl alcohol is caused to be present always in the electrolytic solution by continuously adding m-hydroxybenzoic acid and the acidic aqueous solution to the electrolytic solution, and the electrolysis is carried out at 20° to 70° C.

DETAILED DESCRIPTION OF THE INVENTION

Figure 1:
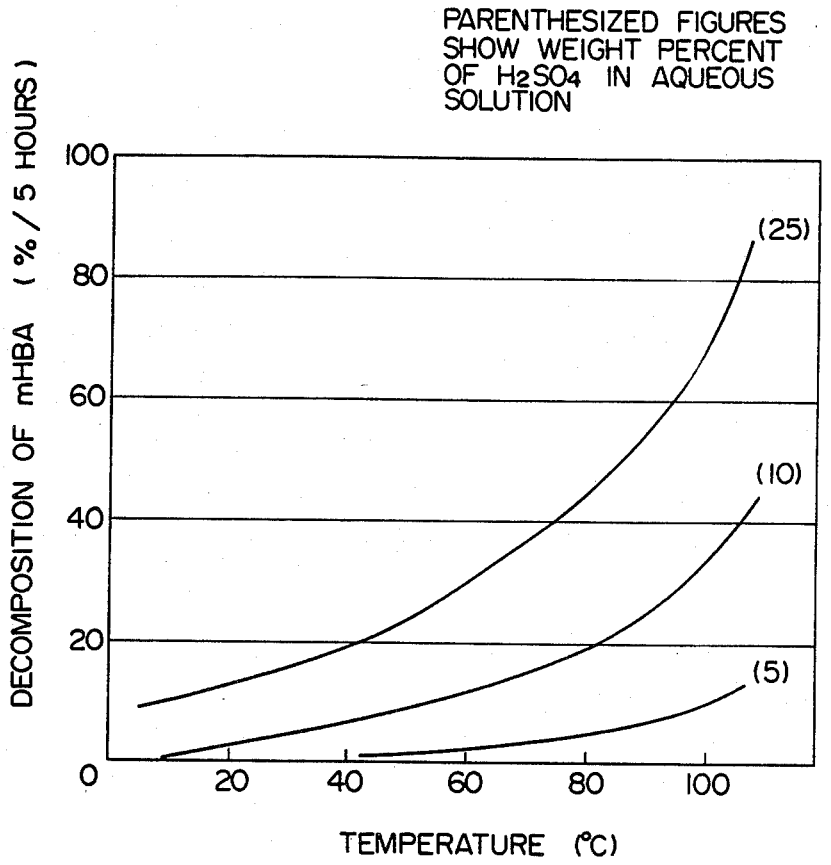
FIG. 1 is a graph showing the relation between the temperature of an aqueous sulfuric acid solution containing mHBA having a sulfuric acid concentration of 5, 10, or 25% by weight and the ratio of thermal decomposition of mHBA after the lapse of 5 hours.
Figure 2:
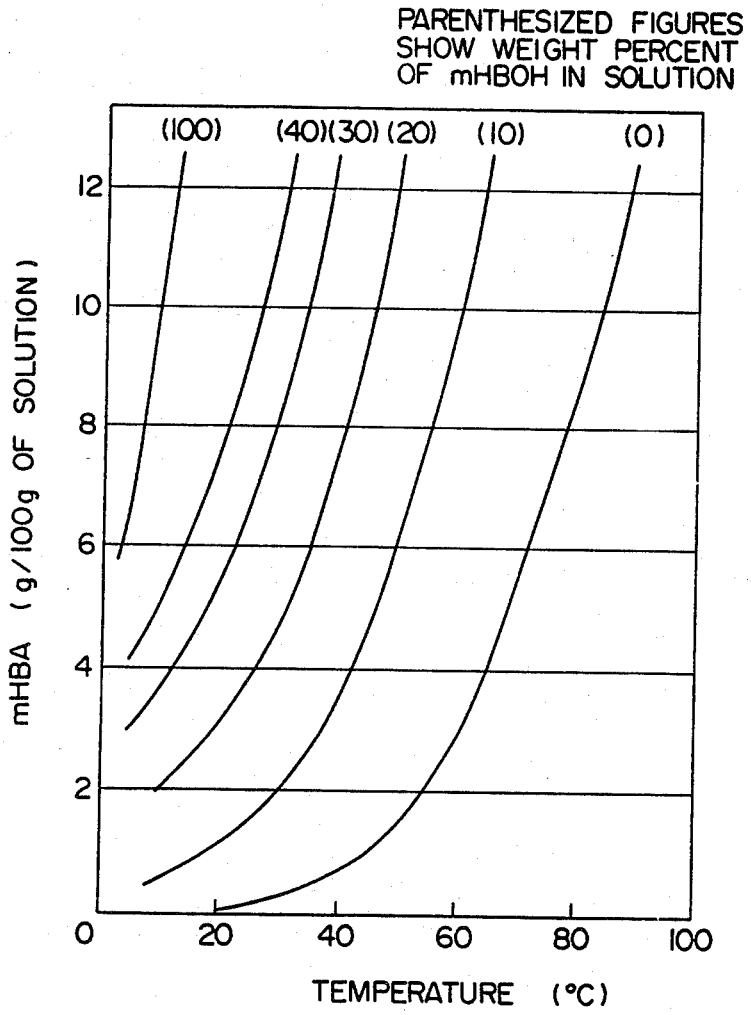
FIG. 2 shows a solubility curve of mHBA at various temperatures using an aqueous solution of mHBOH in 100 g of water, in which the parenthesized figures show the weight percent of mHBOH added.

It is seen from FIGS. 1 and 2 that when, for example, mHBA is dissolved at 90° C. in a 10% aqueous solution of sulfuric acid, decomposition of mHBA occurs at a rate of about 5% per hour. An ordinary reaction of mHBA requires a period of 4 to 5 hours, and decomposition of mHBA to an extent of 20 to 25% during this time cannot be ignored. Furthermore, the problem of the thermal resistance of a cation exchange membrane used as a diaphragm in the electrolytic cell can neither be ignored. Hence, electrolysis at high temperatures is impossible in practice.

It is seen from FIG. 2 that, for example, the solubility of mHBA in an aqueous solution containing 10% by weight of mHBOH is much higher than that in water. In other words, mHBA has such high solubility in this aqueous solution that electrolysis can be industrially carried out at temperatures of 70° C. or less at which the ratio of decomposition of mHBA is relatively low.

mHBA has low solubility in water, whereas mHBOH has high solubility in water. Thus, if mHBOH is dissolved in water, the solubilty of mHBA in water increases. For this reason, the addition of the organic solvent or the supporting electrolytic substance to the electrolytic reduction reaction system is not essential in the process of the invention, and the reaction can be carried out at relatively low reaction temperatures. For this purpose, the presence of mHBOH is always necessary in the electrolytic solution to be subjected to electrolytic reducing reaction.

The constant presence of mHBOH in the electrolytic solution may be effected by a batch method of feeding an electrolytic solution containing mHBOH dissolved therein into an electrolytic cell at the start of charging mHBA. However, since there is a limit to the concentration of the reaction substrate of the electrolytic solution and mHBOH increases gradually with the proceeding of the reaction, the amount of the mHBA charged as a starting material should be decreased, and the production efficiency is reduced. Furthermore, since the reaction time is long, mHBOH is decomposed to some extent.

To avoid such a disadvantage in the batch method, the following methods are employed in this invention.

A first method is to add mHBA continuously to the electrolytic solution. In this method, the rate of adding mHBA is determined by the rate of consumption of mHBA, namely the amount of the electric current passed. The addition is preferably effected so that the concentration of mHBA in the electrolytic solution is kept at not more than 5%. By so doing, the electrolytic reaction proceeds smoothly, and the cumulative concentration of the substrate can be easily maintained at 10% or more. If, however, the concentration is increased too much, the viscosity of the solution increases to affect the electrodes and ion-exchange membranes adversely. Desirably, the final concentration of the reaction substrate should be adjusted to not more than 30%, usually to 10 to 15%.

Since the first method is a semi-batch method, the amount of mHBOH present in the electrolytic cell varies with time, and therefore, the amount of mHBA to be dissolved should be varied accordingly. The reaction operation becomes slightly complex.

A second method which comprises performing the electrolysis while continuously adding mHBA and the acidic aqueous solution to the electrolytic solution is preferred to the first method in this regard. In the second method, the acidic aqueous solution is first charged into the electrolytic cell. Thereafter, fixed amounts of the acidic aqueous solution and mHBA are continuously fed into the cell, and electrolysis is carried out continuously by passing current through the anode and cathode of the electrolytic cell. In the meantime, the electrolytic solution is caused to flow out at a fixed rate from an overflowing pipe provided at the upper portion of the side wall of the cathode chamber, or to flow out from the cathode chamber by means of a metering pump. Preferably, this operation is carried out in a multi-stage electrolytic cell, and the effluent from one cathode chamber is continuously charged into the next cathode chamber. The amount of mHBOH dissolved in the electrolytic cell at the start of electrolysis, and the amount of mHBA to be added to the electrolytic solution should be small. With time, the amount of mHBOH increases, and with it, the amount of mHBA to be dissolved is increased. A steady condition will be reached after a certain period of time, in which a fixed amount of mHBOL is always present in the electrolytic cell and the amount of mHBA dissolved remains constant. As a result, the electrolysis is continuously carried out while the concentration of the reaction substrate is kept always constant, and the electrolytic solution can be withdrawn at a fixed rate. The amount of mHBA added in the steady condition can be determined by the rate of mHBA consumed, namely by the amount of current passed. Preferably, the concentration of mHBA in the electrolytic solution is maintained at 5% or less as in the semi-batch method. By so doing, the concentration of the substrate can be easily adjusted to 10% or more. Usually, the final concentration of the reaction substrate is desirably 10 to 15%, and can be determined depending upon the rate of feeding the aqueous sulfuric acid solution.

The acidic aqueous solution used in the semi-batch method or the continuous method in this invention may be any aqueous acidic substance inert to the electrolytic reaction at the cathode. From the standpoint of cost, a mineral acid is usually preferred, and from the standpoint of the material of the electrolytic cell and the yield of the final product, sulfuric acid is especially preferred. The concentration of the acidic substance in the aqueous solution is 5 to 30% by weight, preferably 10 to 20% by weight. If it is as low as 5% by weight or less, the rate of the reaction is slow although the ratio of decomposition of mHBA is low. If it is as high as 30% by weight or more, the rate of the reaction increases, but the ratio of decomposition of mHBA increases.

The temperature at which the electrolytic reducing reaction is carried out needs not to be maintained at 90° C. or more, but can be 20° to 70° C., preferably 30 to 60° C. If the reaction temperature is less than 20° C., a large amount of mHBOH should be caused to be present in order to dissolve mHBA in the electrolytic solution, and the production efficiency is reduced. At a temperature higher than 70° C., the ratio of decomposition of mHBA becomes high, and the yield of the final product is decreased.

In the present invention, mHBOH to be caused to be present in the electrolytic solution is properly determined depending upon the reaction temperature, the acid concentration, the solubility of mHBa, and the concentration of the reaction substrate.

In the process of this invention, the cathode is made of a material having a high hydrogen overvoltage, specifically zinc, lead, cadmium or mercury. The anode may be of an ordinary electrode material.

mHBOH is formed also in the absence of a diaphragm in the electrolytic cell. But since oxidation occurs also in the anode and the yield of mHBOH based on mHBA decreases, it is preferred to isolate the anode chamber from the cathode chamber by using a cation exchange diaphragm. The diaphragm may be made of asbestos, ceramics, sintered glass, etc.

In the electrolytic reduction in accordance with this invention, the current density is preferably 5 to 30 $A/dm^2$. Theoretically, since the present reduction is 4 electron reduction, the amount of an electric current passed is 4 Fr/mole. Since in practice, the current efficiency is 50 to 70%, a current in an amount of 5 to 8 Fr/mole should be passed in order to complete the reaction.

Since in the present invention, mHBOH is always present in the electrolytic solution, the electrolytic solution is a uniform solution, and the reaction proceeds smoothly without appreciably causing troubles to the electrode surface. However, because the reaction is carried out in the acidic aqueous solution, some decomposition of mHBA and mHBOH unstable to acids is unavoidable during the reaction. In the continuous method, a very small amount of a tarry decomposition product is accumulated as the reaction proceeds, and the adhesion of part of it in a very small amount to the electrode surface cannot be avoided.

The adhesion of the decompositon product to the electrode surface can be prevented by adding 0.001 to 1% by weight, based on the acidic aqueous solution, of a surface-active agent, for example a quaternary ammonium salt-type cationic surface-active agent having the following structure

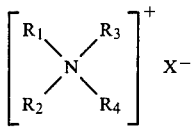

wherein R represents an alkyl group and/or an alkylpolyoxyethylene group, and X is Cl or Br, to emulsilfy the tarry product.

In the present invention, the type of the electrolytic cell is not particularly restricted, and the electrolytic cell may be of any type which permits increased solubility of mHBA and can be used in electrolytic reduction.

In the continuous method, a number of electrolytic cells are required in order to completely reduce the starting mHBA the starting mHBA to mHBOH. But if the presence of the unreacted mHBA is permitted, the electrolytic reduction can be carried out in a single electrolytic cell.

When a multiplicity of electrolytic cells are used in the electrolytic reduction, it is open to choice whether to charge the starting mHBA and an acidic aqueous solution all at a time into a first cell, or in divided portions into the first and following cells.

mHBOH may be isolated from the reaction mass after the reaction by extracting it with an extracting solvent capable of well dissolving mHBOH and being easily separated from water, such as an acetate ester (e.g., propyl acetate and butyl acetate) or an ether (e.g., diethyl ether, dipropyl ether or dibutyl ether), and removing the solvent from the extract.

The extraction can be carried out efficiently with a small amount of the extraction solvent if prior to the extraction, the reaction mass as an acidic aqueous solution is neutralized with an alkali hydroxide such as sodium hydroxide or calcium hydroxide and dissolving an inorganic salt in it to saturation.

Some amount of mHBOH still remains in the acidic aqueous solution after extraction of mHBOH from the reaction mass. To recover it, the acidic aqueous solution left after the extraction may be recycled as a solvent for electrolysis. In this case, the neutralization of the reaction mass and the addition of the inorganic salt described above is not desirable, and the ether is preferably used as the extraction solvent since the acetate undergoes hydrolysis.

As stated above, according to the process of this invention, the electrolytic reaction is carried out at 20° to 70° C.; mHBOH is always present in the electrolytic cell in a constant concentration; and the electrolytic reduction is carried out in an electrolytic solution in which mHBA is dissolved in a maximum concentration at a given temperature. Hence, the residence time per unit amount of mHBOH can be shortened as compared with the batch method, and the thermal decompositon of mHBA at high temperatures can be inhibited. Concequently, the desired product can be obtained in a high yield.

The following examples illustrate the process of this invention more specifically.

EXAMPLE 1

An H-type electrolytic cell was used which included an anode and a cathode chamber each having a capacity of 300 ml and isolated from each other by a diaphragm, Selemion CMV (a tradename for a cation exchange membrane manufactured by Asahi Glass Co., Ltd.). A 10% aqueous solution of sulfuric acid was charged into each of the anode and cathode chambers in an amount of 200 ml. A lead plate having a surface area of 50 $cm^2$ was used as the cathode, and a platinum plate having a surface area of 50 $cm^2$, as the anode.

While the electrolytic cell was maintained at 30° C. and a dc current of 6A was passed, 25 g (0.18 mole) of mHBA was added to the catholyte at a rate of 6 g/hour by means of a microfeeder. In 4.2 hours, all mHBA was added. Electrolysis was then continued for an additional 0.8 hour (6.22 Fr/mole).

After the electrolysis, the catholyte was withdrawn, and at a temperature of 20° to 30° C., about 15.6 g of sodium hydroxide (purity 95%) was added to adjust the pH of the solution to 5. Further, sodium chloride was added and dissolved to saturation. Then, the reaction mass was extracted with three 100 g portions of ethyl acetate.

The ethyl acetate layer and the aqueous layer were analyzed by liquid chromatography (HLC). It was found that the ethyl acetate contained 92.4% of mHBOH based on the mHBA charged, and the aqeuous layer contained 0.7% of mHBOH based on the mHBA charged. The ratio of extraction of mHBOH from the reaction mass was 99.2%. Then, ethyl acetate was evaporated under reduced pressure from the ethyl acetate layer to give 21.1 g of mHBOH as crystals (purity of mHBOH=98.1%; the yield of the isolated mHBOH=92.1%).

EXAMPLE 2

The same electrolytic cell as in Example 1 was used. A 20% aqueous solution of sulfuric acid was fed into each of the cathode and anode chambers in an amount of 200 ml. While the temperature was maintained at 60° C. and a dc current of 12A was passed, 40 g (0.29 mole) of mHBA was added to the catholyte at a rate of 2 g/hour by means of a microfeeder, and electrolysis was carried out at the fixed current for 4 hours (6.17 Fr/mole).

After electrolysis, the resulting catholyte solution was analyzed by HLC and found to contain 0.2% of mHBA and 15.6% of mHBOH.

The yield of mHBOH was 95.4%, and the current efficiency was 61.8%.

COMPARATIVE EXAMPLE

The same electrolytic cell as in Example 1 was used, and 200 ml of a 15% aqueous solution of sulfuric acid was fed into each of the cathode and anode chambers. The aqueous solution was heated to 70° C., and 25 g of mHBA was added to the catholyte. The catholyte was in the form of a slurry. The catholyte was electrolyzed for 5 hours by passing a dc current of 5A (0.933 Fr/mole).

After the electrolysis, the catholyte was analyzed by HLC as in Example 1, and found to contain 1.3% of mHBA, 7.2% of mHBOH and 2% of other substances.

The yield of mHBOH was 70.5%, and the current efficiency was 54.8%.

EXAMPLE 3

An H-type electrolytic cell was used which included an anode and a cathode chamber each having a capacity of 300 ml and isolated from each other by a diaphragm, Selemion CMV (a tradename for a cation exchange membrane manufactured by Asahi Glass Co., Ltd.). A side pipe was provided in the cathode chamber of the elecrolytic cell so that when the amount of the catholyte exceeded 200 ml, it could be continuously withdrawn from it by overflowing.

A 10% aqueous solution of sulfuric acid was fed into each of the cathode and anode chambers in an amount of 200 ml. A lead plate having a surface area of 50 $cm^2$ was used as the cathode, and a platinum plate having a surface area of 50 $cm^2$, as the anode. Electrolysis was carried out for 15 hours at a dc current of 8.5A (5.46 Fr/mole/hour) while maintaining the electrolytic cell at 30° C. and feeding a 10% aqueous solution of sulfuric acid at a rate of 50 g/hour by means of a metering pipe and mHBA at a rate of 8 g (0.058 mole)/hour by a microfeeder.

The catholyte was a uniform clear solution. The catholyte (110 g) which flowed out during 2 hours was analyzed by HLC and found to contain 1.0% of mHBA and 11.9% of mHBOH.

The yield of mHBOH was 91.0%, and the current efficiency was 66.6%.

EXAMPLE 4

The same electrolytic cell as in Example 1 was maintained at 60° C. and electrolysis was carried out for 15 hours at a dc current of 12A while feeding a 20% aqueous solution of sulfuric acid at a rate of 50 g/hour and mHBA at a rate of 12 g (0.087 mole)/hour (5.15 Fr/mole/hour).

The catholyte was a uniform clear solution. The catholyte (115 g) which flowed out in 2 hours was analyzed by HLC and found to contain 1.7% of mHBA and 16.9% of mHBOH.

The yield of mHBOH was 90.0%, and the current efficiency was 69.9 5.

EXAMPLE 5

An electrolytic cell system of the filter press type (two sets of an anode and a cathode) was used which had a lead plate (cathode) having an available electrode area of $10\times10$ $cm^2$ and a platinum plate (anode) having the same size isolated from each other by a diaphragm (Selemion CMV) and in which the distance from the diaphragm to each of the anode and the cathode was 1 cm. A 10% aqueous solution of sulfuric acid was fed in an amount of 200 ml into each of two 300 ml flasks. By means of a pump, the electrolytic solution (aqueous sulfuric acid solution) was circulated into the anode chamber of the electrolytic cell. A side pipe was provided in the cathode chamber so that when the amount of the catholyte exceeded 200 ml, the catholyte overflowed into the cathode chamber of a second similar electrolytic cell. A 10% aqueous solution of sulfuric acid was fed into a first cathode chamber at a rate of 50 g/hour, and mHBA was fed into the first cathode chamber and a second cathode chamber at a rate of 12 g (0.087 mole)/hour. The electrolytic cell system was maintained at 60° C., and a dc current of 12A was fed into each of the first and second electrolytic cells, and electrolysis was carried out for 30 hours (10.30 Fr/mole/hour).

The catholytes in the first and second electrolytic cells were uniform and clear. They were analyzed by HLC. The catholyte from the first cell contained 2.0% of mHBA and 16.5% of mHBOH, and the catholyte from the second cell contained 5.0% of mHBA and 28.2% of mHBOH. The amount of the solution which flowed out from the second catholyte chamber was 65 g/hour.

The yield of mHBOH was 85.0%, and the current efficiency was 66%.

What is claimed is:

1. A process for producing m-hydroxybenzyl alcohol which comprises electrolytically reducing m-hydroxybenzoic acid in an acidic aqueous solution, wherein m-hydroxybenzyl alcohol is caused to be always present in the electrolytic solution by continuously adding to the electrolytic solution m-hydroxybenzoic acid in an amount corresponding to that consumed as the electrolytic reaction proceeds, and the electrolysis is carried out at a temperature of 20° to 70° C.

2. A process for producing m-hydroxybenzyl alcohol which comprises electrolytically reducing m-hydroxybenzoic acid in an acidic aqueous solution, wherein m-hydroxybenzyl alcohol is caused to be always present in the electrolytic solution by continuously adding m-hydroxybenzoic acid and the acidic aqueous solution to the electrolytic solution, and the electrolysis is carried out at a temperature of 20° to 70° C.

3. The process of claim 1 or 2 wherein the reaction temperature is 30° to 60° C.

4. The process of claim 1 or 2 wherein the acidic aqueous solution is a 10–20% by weight aqueous solution of sulfuric acid.

5. The process of claim 2 wherein the electrolysis is carried out in a multistage electrolytic cell.

* * * * *